US009928852B2

(12) United States Patent
Nagle et al.

(10) Patent No.: US 9,928,852 B2
(45) Date of Patent: Mar. 27, 2018

(54) METHOD OF DETECTING A PREDETERMINED FREQUENCY BAND IN AN AUDIO DATA SIGNAL, DETECTION DEVICE AND COMPUTER PROGRAM CORRESPONDING THERETO

(71) Applicant: Orange, Paris (FR)

(72) Inventors: Arnault Nagle, Lannion (FR); Claude Lamblin, Tregastel (FR)

(73) Assignee: ORANGE, Paris (FR)

( * ) Notice: Subject to any disclaimer, the term of this patent is extended or adjusted under 35 U.S.C. 154(b) by 70 days.

(21) Appl. No.: 14/965,528

(22) Filed: Dec. 10, 2015

(65) Prior Publication Data

US 2016/0171986 A1 Jun. 16, 2016

Related U.S. Application Data

(63) Continuation of application No. 14/367,435, filed as application No. PCT/FR2012/052882 on Dec. 11, 2012, now Pat. No. 9,431,030.

(30) Foreign Application Priority Data

Dec. 20, 2011 (FR) ..... 11 61992

(51) Int. Cl.
*G10L 19/00* (2013.01)
*G10L 25/78* (2013.01)
(Continued)

(52) U.S. Cl.
CPC ..... *G10L 25/78* (2013.01); *G10L 19/06* (2013.01); *G10L 19/08* (2013.01); *G10L 19/26* (2013.01); *G10L 19/02* (2013.01)

(58) Field of Classification Search
CPC ..... G10L 19/0208; G10L 19/07; G10L 19/24; G10L 19/02; G10L 19/032; H04W 24/10;
(Continued)

(56) References Cited

U.S. PATENT DOCUMENTS 6,456,963 B1 * 9/2002 Araki ..... G10L 19/0208 704/200.1
2007/0094018 A1 4/2007 Zinser, Jr. et al.
(Continued)

OTHER PUBLICATIONS

International Search Report and Written Opinion in English dated Feb. 18, 2013 for corresponding International Application No. PCT/FR2012/052882, filed Dec. 11, 2012.
(Continued)

*Primary Examiner* — Huyen Vo
(74) *Attorney, Agent, or Firm* — David D. Brush; Westman, Champlin & Koehler, P.A.

(57) ABSTRACT

A method is provided for detecting a predetermined frequency band in an audio data signal which has previously been coded according to a succession of data blocks, among which at least certain blocks contain respectively at least one set of spectral parameters representing a linear prediction filter. Such a method of detection implements, for a current block among the at least certain blocks and for which at least a plurality of spectral parameters of the set have been previously decoded, acts of: determining, among the plurality of previously decoded spectral parameters, the index of the first spectral parameter closest to a threshold frequency; calculating at least one criterion on the basis of the determined index; and deciding whether the predetermined frequency band is detected in the current block, as a function of the criterion calculated.

4 Claims, 4 Drawing Sheets

(51) Int. Cl.

| | |
|---|---|
| ***G10L 19/06*** | (2013.01) |
| ***G10L 19/08*** | (2013.01) |
| ***G10L 19/26*** | (2013.01) |
| *G10L 19/02* | (2013.01) |

(58) Field of Classification Search
CPC ..... H04W 72/0453; H04W 72/0413; H04W 88/08
USPC ..... 704/500–504, 219–230
See application file for complete search history.

(56) References Cited

U.S. PATENT DOCUMENTS

| | | | | |
|---|---|---|---|---|
| 2008/0059166 | A1* | 3/2008 | Ehara | G10L 19/07 704/230 |
| 2009/0240491 | A1* | 9/2009 | Reznik | G10L 19/24 704/219 |
| 2010/0324708 | A1 | 12/2010 | Ojanpera | |

OTHER PUBLICATIONS

3GPP2: "Source-Controlled Variable-Rate Multimode Wideband Speech Codec (VMR-WB) Servive Option 62 for Spread Spectrum Systems" ARIB Standard, XX, XX, No. ARIB STD-T64 C.50052-0 V1.0, Jun. 11, 2004 (Jun. 11, 2004), pp. 1-164, XP002484816.

"3GPP TS 26.190 V10.0.0 (Mar. 2011) 3rd Generation Partnership Project; Technical Specification Group Services and System Aspects; Speech codec speech processing functions; Adaptive Multi-Rate-Wideband (AMR-WB) speech codec; Transcoding functions (Release 12)" Sep. 2014.

Combescure P. et al., "A 16, 24, 32 kbit/s wideband speech codec based on ATCELP", in IEEE International Conference on Acoustics, Speech, and Signal Processing, 1999 (ICASSP99), pp. 5-8 vol. 1.

Chang et al., "Research and Application of Audio Feature in Compressed Domain", IET Conference on Wireless, Mobile and Sensor Networks, 2007. (CCWMSN07), pp. 390-393, 2007.

English translation of the International Written Opinion dated Jun. 20, 2014 for corresponding International Application No. PCT/FR2012/052882, filed Nov. 12, 2012.

Minimum Technical Requirements for user of the HD Voice Logo with GSM/UMTS Issued by GSMA (Annex C) Version 2.o, Nov. 12, 2013. (http://www.gsm.org/membership/industry_logos.htm).

Office Action dated Nov. 18, 2015 for corresponding U.S. Appl. No. 14/367,435, filed Jun. 20, 2014.

* cited by examiner

| $F_e$ | $F_{th}$ | $\alpha$ |
|---|---|---|
| 16 | 4 | 0.25 |
| 16 | 3.4 | 0.21 |
| 12.8 | 4 | 0.31 |
| 12.8 | 3.4 | 0.27 |
| 12 | 4 | 0.33 |
| 12 | 3.4 | 0.28 |
Fig. 3
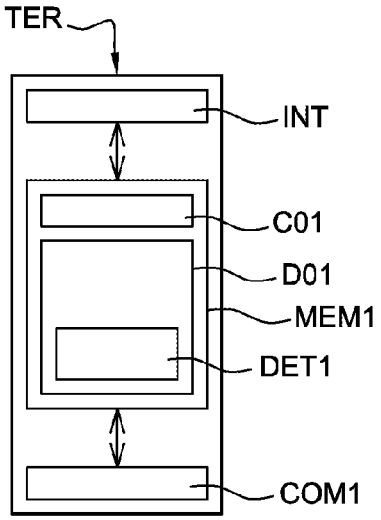
Fig. 6A
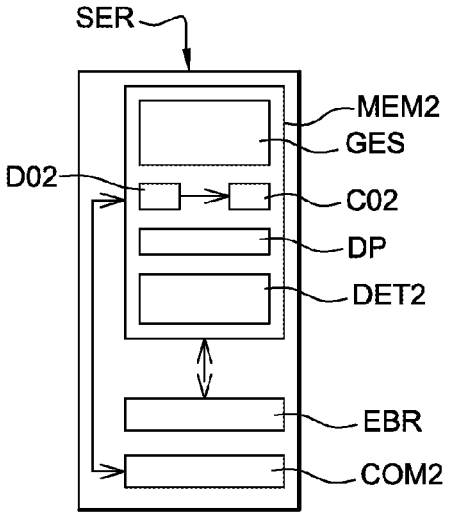
Fig. 6B

METHOD OF DETECTING A PREDETERMINED FREQUENCY BAND IN AN AUDIO DATA SIGNAL, DETECTION DEVICE AND COMPUTER PROGRAM CORRESPONDING THERETO

CROSS-REFERENCE TO RELATED APPLICATIONS

This Application is a continuation of U.S. patent application Ser. No. 14/367,435, filed Jun. 20, 2014, which is a Section 371 National Stage Application of International Application No. PCT/FR2012/052882, filed Dec. 11, 2012, published as WO 2013/093291 on Jun. 27, 2013, not in English, which are incorporated herein by reference in their entireties.

FIELD OF THE INVENTION

The present invention pertains generally to the field of the processing of sound data.

This processing is suitable in particular for the transmission and/or for the storage of multimedia signals such as audio signals (speech and/or sounds).

The present invention is aimed more particularly at the analysis of an audio signal arising from such processing.

More precisely, such processing comprises an LPC linear predictive type coding phase.

BACKGROUND OF THE INVENTION

In the field of compression, coders use the properties of the signal such as its harmonic structure, utilized by long-term prediction filters, as well as its local stationarity, utilized by short-term prediction filters. Typically, the speech signal can be considered to be a stationary signal for example over time intervals of from 10 to 20 ms. It is therefore possible to analyze this signal by blocks of samples called frames, after appropriate windowing. The short-term correlations can be modeled by time-varying linear filters whose coefficients are obtained with the aid of linear predictive analysis on frames, of short duration (from 10 to 20 ms in the aforementioned example).

LPC linear predictive coding is one of the most widely used digital coding techniques, in particular in the mobile telephony sector, in particular in the 3GPP AMR-WB coder such as described in the document "3GPP TS 26.190 V10.0.0 (2011-03) *3rd Generation Partnership Project; Technical Specification Group Services and System Aspects; Speech codec speech processing functions; Adaptive Multi-Rate-Wideband (AMR-WB) speech codec; Transcoding functions (Release* 10)". LPC coding consists in performing an LPC analysis of the signal to be coded so as to determine an LPC filter, and then in quantizing this filter, on the one hand, and in modeling and coding the excitation signal, on the other hand. This LPC analysis is performed by minimizing the prediction error on the signal to be modeled or a modified version of this signal. The autoregressive model of linear prediction of order P consists in determining a signal sample at an instant n through a linear combination of the P past samples (principle of prediction). The short-term prediction filter, denoted A(z), models the spectral envelope of the signal:

$$A(z) = \sum_{i=0}^{P} -a_i \times z^{-i}$$

The difference between the signal S(n) at the instant n and its predicted value S(n) is the prediction error:

$$e(n) = S(n) - \tilde{S}(n) = S(n) + \sum_{i=1}^{P} a_i S(n-i)$$

The calculation of the prediction coefficients is performed by minimizing the energy E of the prediction error given by:

$$E = \sum_{n} e(n)^2 = \sum_{n} \left( S(n) + \sum_{i=1}^{P} a_i S(n-i) \right)^2$$

The way to solve this system is well known, in particular with the Levinson-Durbin algorithm or the Schur algorithm.

The coefficients $a_i$ of the filter must be transmitted to the receiver. However, as these coefficients do not have good quantization properties, transformations are preferably used. Among the most common may be cited:

- the PARCORs coefficients (the abbreviation standing for "*PARtial CORrelation*") consisting of reflection coefficients or coefficients of partial correlation,
- the Logarithmic Area Ratios LAR of the PARCORs coefficients,
- the Line Spectral Pairs LSP.

The LSP coefficients are now the most widely used for the representation of the LPC filter since they lend themselves well to vector quantization.

Other equivalent representations of the LSP coefficients exist:

- the LSF coefficients (the abbreviation standing for "Line Spectral Frequencies"),
- the ISP coefficients (the abbreviation standing for "Immittance Spectral Pairs"),
- or else the ISF coefficients (the abbreviation standing for "Immittance Spectral Frequencies").

The LPC linear predictive coding technique allows a substantial reduction in bitrate in favor of high audio playback quality. However, linear predictive coding lends itself poorly to certain applications for processing coded audio signals, such as the detection of a predetermined frequency band in such coded signals.

It is appropriate to recall that such detection may turn out to be useful, or indeed necessary, having regard at the present time, to the growing multiplicity of audio compression formats.

Indeed, to offer mobility and continuity, modern and innovative multimedia communication services must be able to operate under a great variety of conditions. The dynamism of the multimedia communication sector and the heterogeneity of networks, access and terminals have brought about a proliferation of compression formats whose presence in the communication chains requires several codings either in cascade (transcoding), or in parallel (multi-format coding or multi-mode coding).

In addition to the linear predictive coding technique mentioned hereinabove, there exist other audio compression techniques for reducing bitrate while maintaining good quality, such as for example:

- the PCM "Pulse Code Modulation" techniques,
- and the frequency transform based techniques such as those of the MDCT type (the abbreviation standing for "Modified Discrete Cosine Transformation") or FFT type (the abbreviation standing for "Fast Fourier Transform").

Certain coders combine various coding techniques. Thus in the document Combescure P., Schnitzler J., Fischer K., Kircherr R., Lamblin C., Le Guyader A., Massaloux D., Quinquis C., Stegmann J., Vary P., *A 16, 24, 32 kbit/s wideband speech codec based on ATCELP, in IEEE International Conference on Acoustics, Speech, and Signal Processing,* 1999 (*ICASSP*99), Page(s): 5-8 vol. 1, it is proposed to combine a frequency transform technique of MDCT type and a linear predictive coding technique of CELP type (the abbreviation standing for "Code Excited Linear Prediction") to code wideband signals, the switch between the two technologies being controlled by classification of the signal.

Transcoding is necessary when in a transmission chain, a compressed signal frame emitted by a coder can no longer continue on its path, in this format. Transcoding makes it possible to convert this frame into another format compatible with the rest of the transmission chain. The most elementary solution (and the most common at the present time) is the end-to-end placement of a decoder and of a coder. The compressed frame arrives in a first format, and it is then decompressed. The decompressed signal is then compressed again into a second format accepted by the rest of the communication chain. This cascading of a decoder and of a coder is called a tandem.

In the particular case of a tandem, coders respectively coding different frequency bands can be placed in cascade. Thus, a coder operating in a wide frequency band [50 Hz-7 kHz], also called the WB band (the abbreviation standing for "WideBand") may be required to code an audio content operating in a more restricted frequency band than the wideband. For example, the content to be coded by a 3GPP AMR-WB coder such as mentioned above, although sampled at 16 kHz, may in fact only be in telephone band if such a content has been coded previously by a coder operating in a narrow frequency band [300 Hz, 3400 Hz], also called the NB band (the abbreviation standing for "NarrowBand"). It may also happen that the limited quality of the acoustics of the emitter terminal does not make it possible to cover the whole of the wideband.

It is therefore apparent that the audio band of a stream coded by a coder operating on signals sampled at a given sampling frequency may be much more restricted than that actually supported by the coder.

Among the audio signal processing applications advantageously utilizing the knowledge of the audio frequency band of the content to be processed may be cited:

- audio signals classification,
- automatic speech recognition,
- Speech To Text (STT) conversion of radio or television transmissions containing narrowband passages,
- digital watermarking,
- non-intrusive analysis of streams by probes placed on the media plane in networks, thereby making it possible in particular to detect a change of band of the transported contents and optionally the duration of said contents in a given band, within the network subsequent to this change of band,
- the display on a mobile terminal of an "HD Voice" logo (the abbreviation standing for "High-Definition Voice"), such as approved by the GSMA in August 2011 for mobile terminals and networks and such as described in the document available at the Internet address: http://www.gsm.org/membership/industry_logos.htm,
- the indicator of numbers of calls that have been left in wideband on mobile voice messaging.

Among the known schemes for detecting the frequency band of a digital audio signal, there are those operating in the (original or decoded) signal domain, and those operating in the coded domain.

The detection of the frequency band in the signal domain relies on a spectral analysis of the digital audio signal. By way of example, such detection is implemented in the 3GPP2 VMR-WB codec such as described in the document 3GPP2 C.S0052-0 (Jun. 11, 2004) "Source-Controlled Variable-Rate Multimode Wideband Speech Codec (VMR-WB) Service Option 62 for Spread Spectrum Systems", in order to detect a narrowband audio content which has been oversampled at the sampling frequency of 16 kHz specific to this codec.

The aforementioned codec undertakes a spectral analysis of the temporal signal (after sub-sampling at 12.8 kHz, high-pass filtering and pre-emphasis) by performing two FFT frequency transforms on 256 samples per frame, to obtain two sets of spectral parameters per frame. The spectrum obtained by the FFT analysis is divided into 20 critical bands, the number of frequency bins in these 20 bands being $M_{CB}=\{2, 2, 2, 2, 2, 2, 3, 3, 3, 4, 4, 5, 6, 6, 8, 9, 11, 14, 18, 21\}$. Next, the energy in each critical band is calculated, according to the formula:

$$E_{CB}(i) = \frac{1}{(L_{FFT}/2)^2 M_{CB}(i)} \sum_{k=0}^{M_{CB}(i)-1} (X_R^2(k+j_i) + X_I^2(k+j_i)),$$

$$i = 0, \ldots, 19$$

the index $j_i$ is the index of the first bin of the band i $$\left(j_i = \sum_{k=0}^{i-1} M_{CB}(k) + 1\right),$$

and $X_R(k)$ and $X_I(k)$ being the real and imaginary parts of the FFT spectrum.

In order to correctly process the oversampled narrowband signals, a detection algorithm is applied to detect such signals. It consists in testing the smoothed energy level in the last two bands.

As a variant to the aforementioned FFT transform, other frequency transforms can be used, such as for example the MDCT transform (the abbreviation standing for "Modified Discrete Cosine Transformation").

The detection of the frequency band in the coded domain can rely for its part on prior decoding of the coded signal and then on the application of the techniques of spectral analysis hereinabove such as used in the signal domain to analyze the original audio contents (uncoded or before coding). However, the decoding increases the complexity and the delay of the processing. In many applications, it is therefore desirable, in order to avoid these problems of complexity and/or of delay, to extract the characteristics of the signal without performing a complete decoding of the signal.

Several analysis techniques in the coded domain have been proposed. They relate to transform or sub-band based coders such as the MPEG coders (e.g. MP3, AAC, etc.).

In such coders, the coded stream does indeed comprise coded spectral coefficients, such as for example, the MDCT coefficients in the MP3 coder. Thus in the document Liaoyu Chang, Xiaoqing Yu, Haiying Tan, Wanggen Wan, *Research and Application of Audio Feature in Compressed Domain, IET Conference on Wireless, Mobile and Sensor Networks,* 2007. (*CCWMSN*07), *Page*(*s*): 390-393, 2007, it is proposed, rather than to decode the entirety of the coded audio signal, to decode solely the MDCT coefficients which by themselves make it possible to determine the spectral characteristics of the coded signal. The bandwidth BW of the coded audio content is thus determined on the basis of these MDCT coefficients with the aid of the following expression:

$$BW=\mathrm{Max}\{i|SMRS_i \geq T_{SMRS}\}-\mathrm{Min}\{i|SMRS_i \leq T_{SMRS}\}$$

where $SMRS_i$ is the square root of the energy of the $i^{th}$ band ( $$SMRS_i = \sqrt{\frac{1}{N_i}\sum_j S_{i,j}^2},$$

where $S_{i,j}$ represents the $j^{th}$ coefficient of the $i^{th}$ band and $N_i$, the number of coefficients in the $i^{th}$ band) and $T_{SRMS}$ a threshold.

The schemes for detecting the frequency band of a digital audio signal which have just been described rely mainly on a frequency analysis of the spectrum of the signal. In the case where the audio content has been coded by a frequency transform, the detection of the audio frequency band in the coded content advantageously utilizes the spectral information contained in the coded binary stream while not completely decoding the signal. This noticeably reduces the complexity of the detection by eliminating the expensive operations required by the complete decoding and the spectral analysis (based on FFT or on MDCT) of the coded audio signal.

Now, though transform based compression technologies are very widespread in audio coding (high bitrates, high sampling frequency), such is not the case in speech coding where the coding methods predominantly use linear predictive compression technologies such as described previously and which nevertheless rely on a modeling of the spectral envelope of the signal by the linear-prediction coefficients of the short-term LPC filter and the diverse transformations (e.g.: LSP) used for the quantization.

A solution for determining the audio frequency band of a signal coded by a linear predictive coder consists in decoding the signal and then in applying to it a scheme for detecting frequency band in the signal domain, such as the one described hereinabove. However, such a solution turns out to be very expensive as regards complexity of calculations, therefore giving rise to undesired consumption of the resources of the central processing unit CPU. The complexity of calculations is brought about by the application of the FFT or MDCT frequency transforms which remain complex operations.

Moreover, though in some of the aforementioned audio signal processing applications benefiting from the knowledge of the audio frequency band, the decoded signal is available, such as for example the application consisting in displaying on a mobile terminal of an "HD Voice" logo, such is not the case for all applications. Thus, for example, in the application regarding indicator of numbers of calls that have been left in wideband on mobile voice messaging, the complexity of the decoding must then be added to the complexity of the time-frequency transform and of the detection of the audio band on the basis of the energies per band. Now, in a coder, such as in particular the aforementioned AMR-WB coder, the decoding represents 20% of the coder's total complexity, itself estimated at around 40 WMOPS (the abbreviation standing for "Weighted Millions of Operations Per Second").

As indicated previously, certain coders combine linear predictive coding techniques with other compression techniques such as for example frequency transform based coding techniques of MDCT type. It would then be possible to make do with performing the detection only on the audio signal blocks coded by a frequency transform technique, using a prior art scheme for these blocks. However, this solution would be detrimental to the responsivity of the detection since according to the type of the content and/or the bitrate, linear predictive coding can be used predominantly.

OBJECT AND SUMMARY OF THE INVENTION

One of the aims of the invention is to remedy drawbacks of the art of the aforementioned techniques.

For this purpose, a subject of the present invention relates to a method for detecting a predetermined frequency band in an audio data signal which has been coded according to a succession of data blocks, among which at least certain blocks contain respectively at least one set of spectral parameters representing a linear predictive filter.

The method according to the invention is noteworthy in that it implements, for a current block among said at least certain blocks and of which at least one plurality of spectral parameters of said set have been previously decoded, the steps consisting in:

- determining, among the plurality of previously decoded spectral parameters, the index of the first spectral parameter closest to a threshold frequency,
- calculating at least one criterion on the basis of the index determined,
- deciding whether the predetermined frequency band is detected in the current block, as a function of the criterion calculated.

Such a provision makes it possible to identify, with a low cost of calculations, whether or not the audio frequency band of a content previously coded by a linear predictive coder is more restricted than the audio frequency band in which such a coder operates.

In the case for example of the AMR-WB coder for which the signal is sampled at 16 kHz, and then undersampled at 12.8 kHz with a view to the LPC analysis of the latter, the invention makes it possible to determine for example the presence of an audio content of frequency greater than 4 kHz.

Such a provision is particularly advantageous in the sense that it does not necessarily impose complete decoding of the audio signal. Thus, the invention can be advantageously implemented in certain applications for detecting frequency bands which do not need to carry out a decoding of the coded audio signal, such as for example the indicator of numbers of calls that have been left in wideband on mobile voice messaging.

By virtue of the simplicity of such a detection based mainly on the analysis of the differences in the distributions of just part of the decoded linear-prediction spectral parameters, the performance of this detection is thereby optimized. Furthermore, the complexity of the calculations performed for the implementation of such a detection is markedly reduced in comparison with the complexity of calculations that is brought about by the application of FFT or MDCT frequency transforms to decoded signals of the prior art frequency band detection schemes.

In a particular embodiment, all the spectral parameters of the aforementioned set of spectral parameters are decoded beforehand.

Such a provision makes it possible to detect in a simple manner the frequency band of a decoded audio content, by direct access to the decoded linear-prediction parameters associated with this content, and without adding extra complexity (complete decoding, time-frequency transform).

Thus, for example, the invention is particularly suitable for its implementation in a communication terminal, fixed or mobile, which comprises by nature an audio coder and decoder, and more precisely for the application in this terminal which consists in displaying on the screen of the latter an "HD Voice" logo.

In yet another embodiment, in the case where among the succession of data blocks, certain blocks each contain a set of spectral parameters representing a linear predictive filter and certain other blocks each contain a set of spectral parameters obtained by frequency transformation, only the blocks each containing a set of spectral parameters representing a linear predictive filter are considered, with a view to the detection according to the invention.

Since this involves blocks each containing a set of spectral parameters obtained by frequency transformation, a frequency band detection scheme of the prior art will for example be able to be applied.

In another particular embodiment, when the predetermined frequency band to be detected is the band of the high frequencies, the determining step consists in preferably searching for the index of the first spectral parameter above a threshold frequency.

According to the invention, "band of the high frequencies" is intended to mean the band of the frequencies above a certain threshold. For example, in wideband, it may be considered that the high-frequency band corresponds to the frequencies above 4 kHz (or 3.4 kHz). More generally, for a signal sampled at a sampling frequency Fe and of bandwidth less than or equal to 0.5 Fe, the band of the high frequencies will be the band of the frequencies above $\alpha'0.5$ Fe ($0<\alpha'<1$), $\alpha'$ being adjustable.

Likewise, "band of the low frequencies" is intended to mean the band of the frequencies below a certain threshold. When the predetermined frequency band to be detected is the band of the low frequencies, said determining step consists in preferably searching for the index of the last spectral parameter below a threshold frequency.

Such a provision thus makes it possible to implement the invention for example in HD quality voice processing applications, in particular equally well in a mobile communication terminal capable of operating in the aforementioned span of frequencies, or in a voice messaging server capable of processing HD audio contents, or indeed within a probe spliced into the audio stream of a communication network.

In yet another particular embodiment, the current block contains data representative of voice activity.

An optional provision such as this makes it possible, in the particular case which involves detecting in the coded audio signal a band situated in the high frequencies, to optimize the reduction in the complexity of the detection method by performing the detection, not on all the frames containing at least one set of spectral parameters representing a linear predictive filter, but only on relevant frames liable to contain high frequencies, that is to say those liable to contain voice and/or music data.

In yet another particular embodiment, the criterion is calculated by comparison between:

- the maximum value of the distance between two neighboring decoded spectral parameters, said value being estimated with respect to the value of the index of the first decoded spectral parameter which has been obtained on completion of the determining step,
- the minimum value of the distance between two neighboring decoded spectral parameters, said value being estimated with respect to the value of the index of the first decoded spectral parameter which has been obtained on completion of the determining step.

Such a provision makes it possible to carry out, on the basis of a simple calculation, if the predetermined frequency band is detected, while complying with a detection complexity/reliability/responsivity compromise.

As a variant, the aforementioned criterion is calculated with the aid of a mathematical function using as parameter at least the index of the first decoded spectral parameter which has been obtained on completion of the aforementioned determining step.

In yet another particular embodiment, subsequent to the decision step implemented for the current block, a global decision step is implemented by smoothing of the result of this decision step and of K earlier decision results, relating respectively to K blocks preceding the current block. Such a smoothing over several blocks of the local detections specific to each block thus makes it possible to increase the reliability of detection and for example to guard against an audio content that is actually narrowband for a few frames (e.g. noise).

Correlatively, the invention relates to a detection device intended to implement the detection method according to the invention. The detection device according to the invention is therefore intended to detect a predetermined frequency band in an audio data signal which has been coded according to a succession of data blocks, among which at least certain blocks contain respectively at least one set of spectral parameters representing a linear predictive filter.

Such a detection device is noteworthy in that it comprises means for processing a current block among said at least certain blocks and of which at least one plurality of spectral parameters of said set have been previously decoded, which means are able to:

- determine among the plurality of previously decoded spectral parameters, the index of the first spectral parameter closest to a threshold frequency,
- calculate at least one criterion on the basis of the index determined,
- decide whether the predetermined frequency band is detected in the current block, as a function of the criterion calculated.

In particular, such a detection device is intended to implement all the embodiments of the detection method which were mentioned hereinabove. In other particular embodiments, the detection device is able to be contained in a communication terminal, in a voice messaging server or else in a probe.

The invention is also aimed at a computer program comprising instructions for the execution of the steps of the detection method hereinabove, when the program is executed by a computer.

Such a program can use any programming language, and be in the form of source code, object code, or of code intermediate between source code and object code, such as in a partially compiled form, or in any other desirable form.

Yet another subject of the invention is also aimed at a recording medium readable by a computer, and comprising instructions for a computer program such as mentioned hereinabove.

The recording medium can be any entity or device capable of storing the program. For example, such a medium can comprise a storage means, such as a ROM, for example a CD ROM or a microelectronic circuit ROM, or else a magnetic recording means, for example a diskette (floppy disk) or a hard disk.

Moreover, such a recording medium can be a transmissible medium such as an electrical or optical signal, which can be conveyed via an electrical or optical cable, by radio or by other means. The program according to the invention can be in particular downloaded on a network of Internet type.

Alternatively, such a recording medium can be an integrated circuit in which the program is incorporated, the circuit being adapted for executing the method in question or to be used in the execution of the latter.

The aforementioned detection device and computer program exhibit at least the same advantages as those conferred by the detection method according to the present invention.

BRIEF DESCRIPTION OF THE DRAWINGS

Other characteristics and advantages will become apparent on reading preferred embodiments described with reference to the figures in which:

FIG. 3 represents various examples of threshold frequency values used in the detection method and device according to the invention, FIG. 6A represents a mobile communication terminal able to implement the detection method such as represented in FIG. 1, FIG. 6B represents a voice messaging server able to implement the detection method such as represented in FIG. 1.

GENERAL PRINCIPLE OF THE DETECTION METHOD

The general principle of the invention will now be described with reference to FIGS. 1 and 2.

Figure 1:
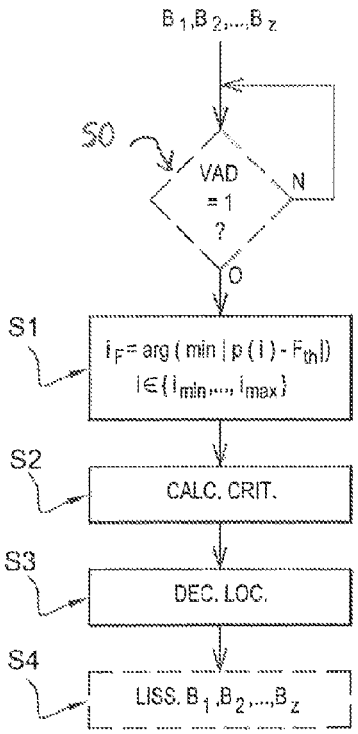
FIG. 1 represents the main steps of the detection method according to the invention.

In FIG. 1, the frequency band detection method according to the invention is represented in the form of an algorithm comprising steps S0 to S4.

Figure 2:
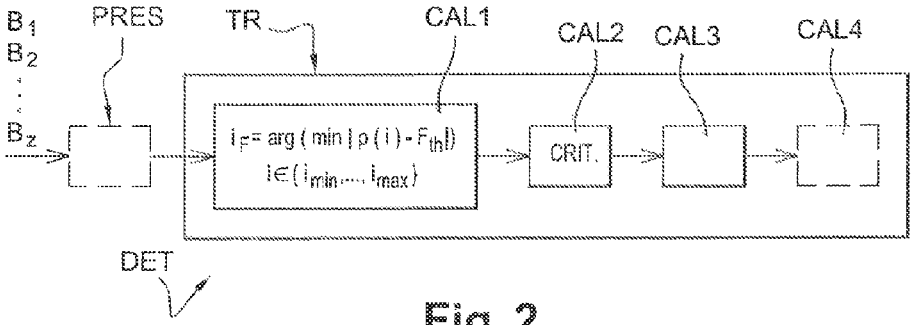
FIG. 2 represents an embodiment of a detection device according to the invention.

In FIG. 2, the aforementioned detection method is implemented in a software or hardware manner in a detection device DET represented in FIG. 2, which comprises for this purpose a processing module TR specific to detection.

With a view to the detection of a predetermined frequency band in an audio signal considered, such a detection device DET is intended to be arranged:

- either associated with an audio decoder so as to recover certain decoded parameters, which will be described further on in the description, associated with said decoded audio signal,
- or independently of the decoder so as to read the coded audio signal and then to perform a partial decoding of certain coded parameters, which will be described further on in the description, associated with said coded audio signal,
- or spliced into a coded audio signal so as to read said signal and then to perform a partial decoding of certain coded parameters, which will be described further on in the description, associated with said coded audio signal.

In the case of an arrangement of the detection device DET in an audio decoder, the detection device DET is for example contained in a fixed or mobile communication terminal.

In the case of an arrangement of the detection device DET independently of the decoder or else spliced into a coded audio signal, the detection device DET is for example contained in an element of the audio signal transmission chain (e.g.: messaging server in which the audio messages are stored without decoding).

Prior to the implementation of the method for detecting a predetermined frequency band in an audio signal, there is undertaken the coding of this signal, which has previously been sampled at a predetermined sampling frequency Fe.

According to the invention, the coding of said signal is performed for example in a linear predictive coder using short-term LPC spectral parameters, such as ISP coefficients or an associated representation, covering at least part of the spectrum in frequencies (normalized or not).

Said coder is for example the 3GPP AMR-WB coder, such as mentioned above in the description.

By way of alternative, the coding of said signal could be performed by a coder such as for example the one which was mentioned above in the description, which combines a frequency transform technique of MDCT type and a linear predictive coding technique of CELP type.

In the example represented, the sampling frequency is equal to 16 kHz, corresponding to the nominal sampling frequency of the AMR-WB coder operating in the useful band from 50 Hz to 7 kHz.

On completion of the linear predictive coding step carried out in the AMR-WB coder is obtained a plurality Z of consecutive data blocks $B_1, B_2, \ldots, B_Z$, as represented in FIGS. 1 and 2. Each block contains at least one set of spectral parameters representing a linear predictive filter.

In the case of the aforementioned alternative, on completion of the coding step is obtained a plurality of consecutive data blocks, certain of said blocks containing at least one set of spectral parameters representing a linear predictive filter and certain others of said blocks containing at least one set of spectral parameters obtained by frequency transform.

Next is implemented the method for detecting a predetermined frequency band of the audio signal which has just been coded, on the basis of an analysis of each of the aforementioned blocks.

The detection method according to the invention is applied solely to the blocks which contain at least one set of spectral parameters representing a linear predictive filter, a plurality of these parameters having been previously decoded.

In the case of the aforementioned alternative, since this involves blocks each containing a set of spectral parameters obtained by frequency transform, a frequency band detection scheme of the prior art will for example be able to be applied.

In accordance with the embodiment, the predetermined frequency band is the HF band of a wideband content.

In the course of a step S1 represented in FIG. 1, there is undertaken the processing of a current block $B_n$ (n being an integer such that $1 \leq n \leq Z$). The current block $B_n$ contains M previously decoded spectral parameters $p(i_k)$, having an ordered subset of M' ($M' \leq M$) spectral parameters which extends for example between the indices $i_{min}$ and $i_{max}$, such that $p(i_{min}) < \ldots < p(i_k) \leq \ldots \leq p(i_{max})$, where $i_{min}$ represents the index of the smallest spectral parameter of said subset and $i_{max}$ represents the index of the largest spectral parameter of said subset.

For the sake of conciseness, the case where the spectral parameters of the ordered subset satisfy the relation: $p(i)<p(j)$ if $i<j$, $i, j \in \{i_{min}, \ldots, i_{max}\}$ is described hereinafter. It is obvious to the person skilled in the art that the invention applies to other cases too: such as for example, the case where the spectral parameters of the ordered subset satisfy the relation: $p(i)>p(j)$ if $i<j$, $i, j \in \{i_{min}, \ldots, i_{max}\}$.

The aforementioned step S1 is implemented by a first calculation software sub-module CAL1 of the detection device DET, such as represented in FIG. 2.

For this purpose, the calculation sub-module CAL1 determines, among said M' spectral parameters, the index $i_F$ of the first spectral parameter which is the closest to a threshold frequency, said threshold frequency being determined on the basis of the sampling frequency $F_e$ of said audio signal.

$$i_F = \arg\left(\min_{i \in \{i_{min}, \ldots, i_{max}\}} |p(i) - F_{th}|\right)$$

In the example represented, $F_{th} = \alpha F_e$ ($\alpha < 0.5$), where $\alpha$ is an adjustable parameter. FIG. 3 represents various possible values of $F_{th}$ according to the sampling frequency $F_e$ used and the value of the parameter $\alpha$.

More particularly, in the course of step S1, the calculation sub-module CAL1 searches for the index $i_{HF}$ of the first spectral parameter $p(i_k)$ greater than $F_{th}$ in accordance with the following operation:

$$i_{HF} = \min\left(\arg_{i \in \{i_{min}, \ldots, i_{max}\}} (p(i) \geq F_{th})\right)$$

Or conversely, in the course of step S1, the calculation sub-module CA1 searches for the index $i_{BF}$ of the last spectral parameter p(i) less than $F_{th}$ in accordance with the following operation:

$$i_{BF} = \max\left(\arg_{i \in \{i_{min}, \ldots, i_{max}\}} (p(i) \leq F_{th})\right)$$

Preferably, step S1 is preceded by a preselection step S0, in the course of which are preselected, among the blocks $B_1, B_2, \ldots, B_Z$, solely blocks which contain data representative of voice activity.

The detection of voice activity of such blocks is performed conventionally during the coding of these latter by a Voice Activity Detection VAD module, which:

- either uses the information available in the block (e.g.: indicator VAD=1 in the coded block, "DTX on" mode of the DTX Discontinuous Transmission module, classification of the block coded as containing voice activity when the block has been coded by an EVRC coder (the abbreviation standing for "Enhanced Variable Rate CODEC")),
- or calculates in the coded audio signal a voice activity criterion.

The preselection step S0 is implemented by a preselection software module PRES represented in FIG. 2.

Step S0 being optional, it is represented dashed in FIG. 1. In a corresponding manner, the module PRES of FIG. 2 is also represented dashed.

There is thereafter undertaken, in the course of a step S2 represented in FIG. 1, the calculation of at least one criterion on the basis of said index $i_F$ determined. Such a step is implemented by a second calculation software sub-module CAL2 of the detection device DET, such as represented in FIG. 2.

According to a first variant embodiment, such a criterion is based on the comparison of the "distance" between two successive spectral parameters with respect to the index $i_F$ determined.

Such a distance is evaluated in accordance with the relation hereinbelow:

$$d(i) = \mathrm{dist}(p(i), p(i-1))$$

Preferably, such a distance corresponds to the simple difference between two successive spectral parameters:

$$d(i) = \mathrm{dist}(p(i), p(i-1)) = ((p(i) - p(i-1))$$

More precisely, the software sub-module CAL2 firstly calculates respectively:

- the maximum value $d_{max}$ of the distance between two neighboring spectral parameters, said value being estimated with respect to the index $i_F$ determined, and
- the minimum value $d_{min}$ of the distance between two neighboring spectral parameters, said value being estimated with respect to the index $i_F$ determined.

Such a calculation is performed according to the following relations hereinbelow:

$$d_{max} = \max_{i_k \in [i_{HF}, i_{max}]} (d(i_k)) = \max_{i_k \in [i_{HF}, i_{max}]} ((p(i_k) - p(i_k - 1)))$$

and $$d_{min} = \max_{i_k \in [i_{HF}, i_{max}]} (d(i_k)) = \min_{i_k \in [i_{HF}, i_{max}]} ((p(i_k) - p(i_k - 1)))$$

or else $$d_{max} = \max_{i_k \in [i_{min}, i_{BF}]} (d(i_k)) = \max_{i_k \in [i_{min}, i_{BF}]} (p(i_k) - p(i_k - 1))$$

and $$d_{min} = \min_{i_k \in [i_{min}, i_{BF}]} (d(i_k)) = \min_{i_k \in [i_{min}, i_{BF}]} (p(i_k) - p(i_k - 1))$$

Next the calculation software sub-module CAL2 calculates a criterion as a function of the two calculated distances $d_{max}$ and $d_{min}$ so as to detect the presence of an HF (or LF) audio content. This criterion is denoted for example crit ($d_{min}$, $d_{max}$).

Preferably, this criterion is the ratio ρ between the two previously calculated distances, such that:

$$\rho=\text{crit}(d_{min},d_{max})=d_{max}/d_{min} \quad (\text{or} \quad \text{crit}(d_{min},d_{max})=d_{min}/d_{max})$$

According to a second variant embodiment, such a criterion is based on a mathematical function $F(i_F)$ using the index $i_F$ as parameter.

Said mathematical function $F(i_F)$ consists for example of a piecewise affine function such that:

$$F(i_F)=a_0 i_F+b_0 \text{ si } i_{min}\leq i_F<l_0$$

$$F(i_F)=a_1 i_F+b_1 \text{ si } i_0\leq i_F<l_1$$

$$F(i_F)=a_{N-1} i_F+b_{N-1} \text{ si } l_{N-2}\leq i_F\leq i_{max}$$

In particular, said function can be in four pieces, such that:

$$\text{if } i_{min}\leq i_F<8,\ F(i_F)=4*i_F-36$$

$$8\leq i_F<10,\ F(i_F)=3*i_F-30$$

$$10\leq i_F<13,\ F(i_F)=2*i_F-21$$

$$13\leq i_F\leq i_{max},\ F(i_F)=3*i_F-30$$

Thus, according to this variant, the criterion depends on the value of the affine function.

Other functions can of course be used. The following function will be cited for example:

$$F(i_F)=\text{sign}(i_F-c)*(i_F-c)^2, \quad \text{where} \quad \text{sign}(x)=-1 \text{ if } x<0,=1 \text{ sign}(x)=1 \text{ otherwise},$$

where c is a variable or a constant equal to about 10.5.

Subsequent to the aforementioned step S2, a step S3 represented in FIG. 1 consists in deciding whether the predetermined frequency band is detected in the current block $B_n$, as a function of one of the criteria which was calculated in step S2. Such a step is implemented by a third calculation software sub-module CAL3 of the detection device DET, such as represented in FIG. 2.

By way of alternative, the decision is dependent on one or the other of the two criteria mentioned hereinabove, or else on a combination of them.

In the case where the calculated criterion complies with the first aforementioned variant, namely $\rho=d_{max}/d_{min}$, the decision can be soft or hard.

For the sake of conciseness, the case where the decision step relates to the detection of a band of high frequencies is described hereinafter. It is obvious to the person skilled in the art to apply this decision step in a similar manner, involving the detection of another frequency band, such as for example a band of low frequencies.

The hard decision consists in comparing the criterion ρ with an adaptive or non-adaptive predetermined threshold, denoted $\text{crit}_{th}$. The comparison is for example performed according to the calculations hereinbelow:

$$\text{If } \rho>\text{crit}_{th},\ \text{flag}_{HF}=1$$

$$\text{otherwise flag}_{HF}=0$$

where $\text{flag}_{HF}$ is a bit which is either set to 1 to indicate that the HF content has been detected, or set to 0 to indicate that the HF content has not been detected.

A soft decision consists for example in using the value of ρ bounded in the interval [1,3]. The closer this value is to the lower bound "1" of this interval, the more an HF content is considered not detected in the block of the audio signal. The closer this value is to the upper bound "3" of the interval, the more an HF content is considered detected in the audio signal.

Let us now consider the case where the criterion is $\rho'=d_{min}/d_{max}$.

The hard decision consists in comparing the criterion ρ' with an adaptive or non-adaptive predetermined threshold, denoted $\text{crit}'_{th}$. The comparison then being:

$$\text{If } \rho'>\text{crit}'_{th},\ \text{flag}_{HF}=0$$

$$\text{otherwise flag}_{HF}=1$$

where $\text{flag}_{HF}$ equals 1 (respectively 0) indicates that the HF content has been detected, (resp. that the HF content has not been detected).

The soft decision consists for example in using the value of ρ' in the interval [0,1]. The closer this value is to the lower bound "0" of this interval, the more an HF content is considered to be detected in the block of the audio signal. The closer this value is to the upper bound "1" of the interval, the more an HF content is considered not to be detected in the audio signal. The closer the value of the criteria is to the bounds of the interval, the more reliable the decision for the block (detection or not of HF content) appears to be, while a value of ρ' close to the threshold $\text{crit}'_{th}$ indicates a low reliability of the decision.

In the case where the calculated criterion complies with the second aforementioned variant, namely a mathematical function $F(i_F)$, the decision can also be soft or hard.

Let us take for example the case where the mathematical function $F(i_F)=\text{sign}(i_F-c)*(i_F-c)^2$ serves to detect whether an HF content is present.

A hard decision consists for example in comparing the criterion $F(i_{HF})$ with 0, according to the calculations hereinbelow:

$$\text{If } F(i_{HF})<0,\ \text{flag}_{HF}=1$$

$$\text{otherwise flag}_{HF}=0$$

where $\text{flag}_{HF}$ is a bit which is either set to 1 to indicate that the HF content has been detected, or set to 0 to indicate that the HF content has not been detected.

In this case, the soft decision can then consist in taking the value of the mathematical function. The more negative (respectively positive) this value, the higher the reliability of the detection of the presence (respectively of the absence) of an HF content. On the other hand, a value of the mathematical function close to zero indicates that the reliability of the detection is low.

In the case where the detection device DET already holds K decision results relating respectively to K blocks preceding the current block $B_n$, it is advantageous, in order to increase the reliability of the detection, to undertake, in the course of a following step S4 represented in FIG. 1, a smoothing of these K results and of the result of the decision which has just been obtained for the current block $B_n$ in the aforementioned step S3, by a window, optionally sliding. Here again, the detection over the window can be a soft or hard decision, whether the local detections relating to each block have been obtained by soft or hard decision. Such a smoothing step S4 is implemented by a fourth calculation software sub-module CAL4 represented in FIG. 2.

Step S4 being optional, it is represented dashed in FIG. 1. In a corresponding manner, the sub-module CAL4 of FIG. 2 is also represented dashed.

In the embodiment represented, where the audio coder is the 3GPP AMR-WB coder, each block of coded data contains 16 parameters, the first 15 of which are ordered spectral parameters covering the (normalized) spectrum between 0 and 6.4 kHz, the sixteenth parameter being the voice activity indicator (VAD) coded on one bit.

Figure 4A:
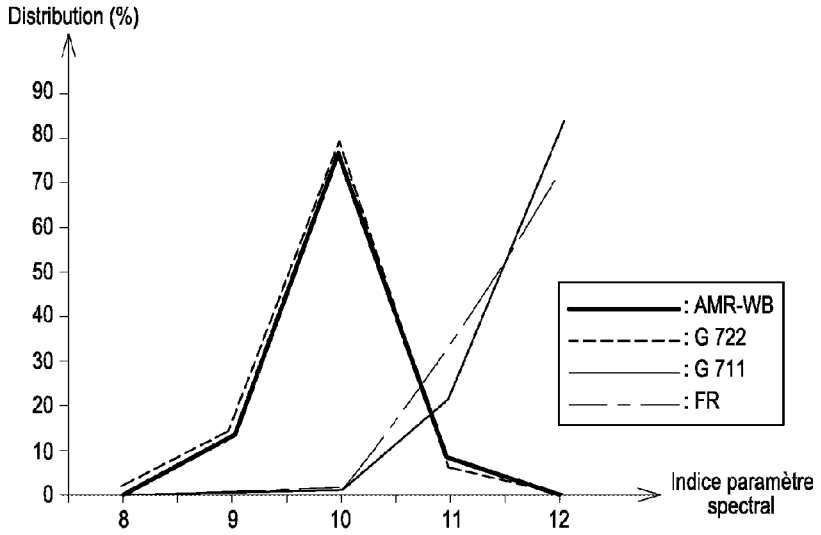
FIG. 4A represents a histogram of the index of the first spectral parameter greater than 4 kHz, for the blocks coded by the AMR-WB coder containing data representative of voice activity (flagVAD=1)
Figure 4B:
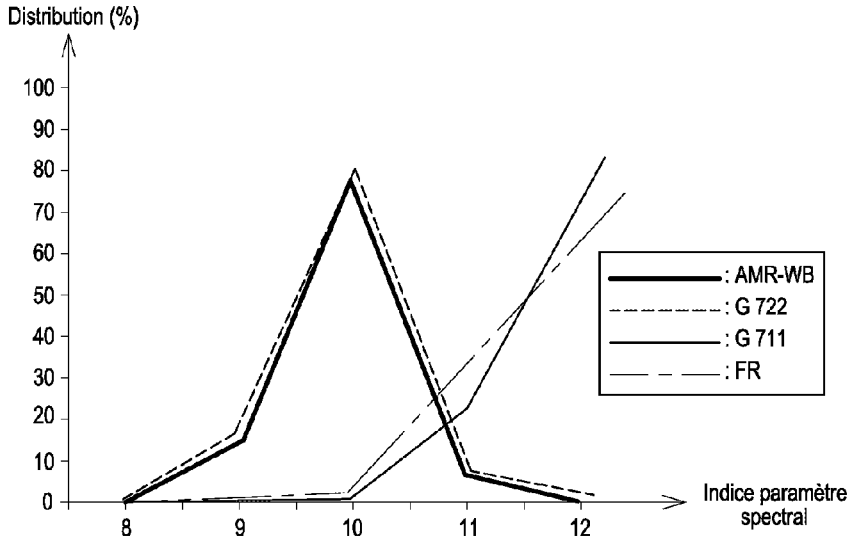
FIG. 4B represents a histogram of the index of the first spectral parameter greater than 4 kHz, for all the blocks coded by the AMR-WB coder, without taking account of the voice activity indication.

FIGS. 4A and 4B each represent a histogram of the index $i_{HF}$ of the spectral parameter p(i) greater than $F_{th}$=4 kHz of the AMR-WB codec. The indices are represented as abscissa and the distribution of these indices as a percentage is represented as ordinate. In FIG. 4A, the detection method which has been implemented comprises step S0 of preselecting the blocks containing voice activity. In FIG. 4B, the detection method which has been implemented does not comprise step S0. Four different configurations are represented by way of example in FIGS. 4A and 4B: that represented by a solid bold line which corresponds to the AMR-WB codec alone, that represented dashed which corresponds to the AMR-WB coder disposed in tandem after another WB coder, such as for example the 64 kbit/s G.722 HD fixed coder, that represented by a thin line which corresponds to the AMR-WB coder disposed in tandem after an NB coder such as for example the G.711 pivot coder, and that represented by a chain-dotted line which corresponds to the AMR-WB coder disposed in tandem after an NB coder, such as the FR mobile coder (the abbreviation standing for "Full Rate").

The histograms were obtained on long speech files with various background noise (road traffic, cafeteria, hubbub), taking account of three different signal-to-noise ratios SNR (SNR=5, 10, 20 dB).

As shown by FIGS. 4A and 4B, the distribution of the index of the first spectral parameter greater than 4 kHz differs markedly depending on whether the first coder is of WB or NB type. In particular for the WB coders, a spike is obtained for an index $i_{HF}$=10.

Figure 5A:
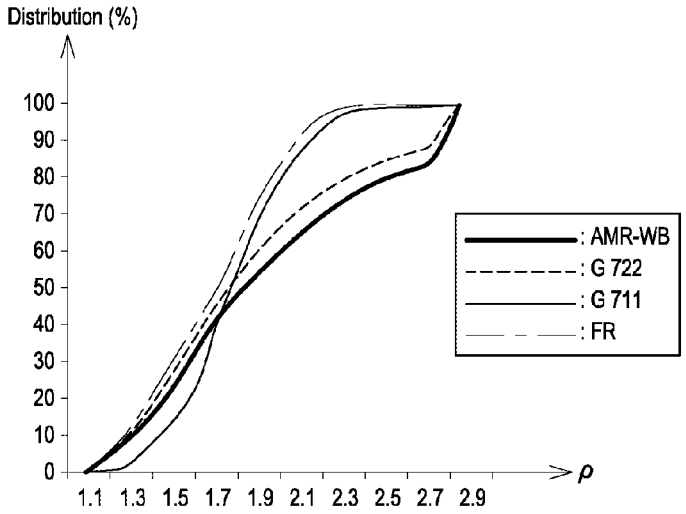
FIG. 5A represents a cumulative histogram of the ratio between the maximum difference and the minimum difference between two successive spectral parameters on the basis of the index of the first spectral parameter greater than 4 kHz, for the blocks coded by the AMR-WB coder containing data representative of voice activity (flagVAD=1)
Figure 5B:
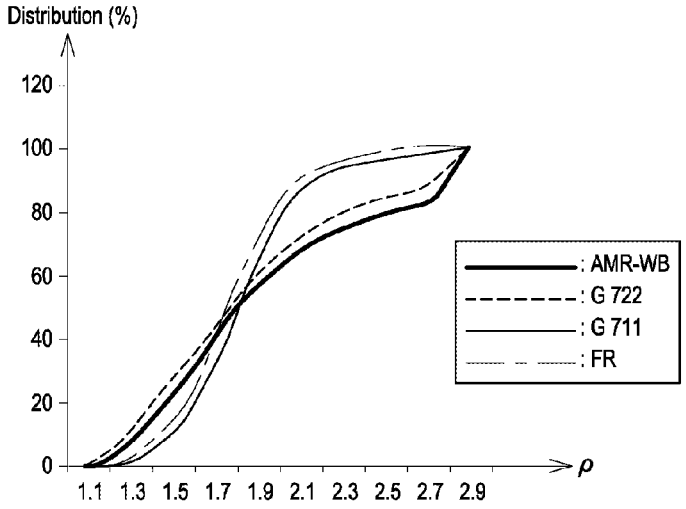
FIG. 5B represents a cumulative histogram of the ratio between the maximum difference and the minimum difference between two successive spectral parameters on the basis of the index of the first spectral parameter greater than 4 kHz, for all the blocks coded by the AMR-WB coder, without taking account of the voice activity indication.

In a corresponding manner, FIGS. 5A and 5B each represent a cumulative histogram of the ratio ρ between the maximum difference and the minimum difference between two successive spectral parameters on the basis of the index $i_{HF}$ of the spectral parameter greater than $F_{th}$=4 kHz of the AMR-WB codec. The values of the ratio ρ are represented as abscissa and the distribution of these ratios as a percentage is represented as ordinate. In FIG. 5A, the detection method which has been implemented comprises step S0 of preselecting the blocks containing voice activity. In FIG. 5B, the detection method which has been implemented does not comprise step S0. Four configurations, which correspond respectively to those of FIGS. 4A and 4B, are represented in FIGS. 5A and 5B. The four configurations of FIGS. 5A and 5B are symbolized in the same manner as in FIGS. 4A and 4B.

As shown by FIGS. 5A and 5B, the distribution of the ratio ρ differs markedly depending on whether the coder is of WB or NB type. In particular, the distributions of the ratio ρ relating to the WB coders and the distributions of the ratio ρ relating to the NB coders deviate from one another onwards of ρ=1.9.

Such examples of distributions are thus utilized advantageously by the invention to detect whether an audio signal coded by a linear predictive coder such as the AMR-WB coder contains high frequencies, such detection being advantageously performed:

with low algorithmic complexity, without complete decoding of the audio signal for certain audio applications not offering any audio decoding, without applying an expensive frequency transform.

We shall now describe a first application of the detection method which has just been described hereinabove with a view to the display of an HD logo on an HD mobile communication terminal.

Such a terminal is designated by the reference TER in FIG. 6A.

In a manner known per se, the terminal TER comprises:

a user interface INT conventionally comprising a keyboard, a screen, a microphone and a loudspeaker, a communication module COM1, for example of 3G type, a read-only memory MEM1 comprising an audio coding module CO1 and an audio decoding module DO1.

In the example represented, the coding module CO1 and the decoding module DO1 are of the AMR-WB type.

In accordance with the invention, the read-only memory MEM1 or else another memory of the mobile terminal TER furthermore contains a detection device DET1 for detecting a predetermined frequency band, similar to the detection device DET represented in FIG. 2.

In this application, in a conventional manner, a coded audio stream is received by the communication module COM1, and then entirely decoded by the decoding module DO1, in such a way that the mobile terminal TER plays back the speech by way of the loudspeaker of its user interface INT. Featuring among the decoded parameters delivered by the decoder DO1 to the detection device DET1 are the first 15 ISF coefficients, ordered spectral parameters covering the (normalized) spectrum between 0 and 6.4 kHz, and optionally the indicator VAD whose value is set to 1 if the encoder of the terminal that emitted the coded audio stream destined for the terminal TER has estimated that the signal of the frame was active (tonality, speech, music), or to zero otherwise.

On the basis of said first 15 ISF coefficients and optionally of the indicator VAD, the detection device DET1 of the terminal TER then directly implements the predetermined frequency band detection method such as described in FIG. 1, with low complexity much less for example than the complexity of the application of a time-frequency transform to the previously decoded signal.

For this purpose, prior to the implementation of the aforementioned step S0, there is undertaken, in the case where the optional smoothing step S4 is implemented, the initialization to zero of the following four values:

a global criterion critGlob, an index ind, for indexing a table of local criteria, a frame counter nbFrm in respect of the frames for which a decision has been taken, an array tabDec of local decisions.

On completion of the initialization step, the following values are obtained:

critGlob=0;

ind=0;

nbFrm=0;

tabDec[i]=0; with i=0, . . . , nbCount, where nbCount is the number of local decisions on the basis of which a global decision (0<nbCount) is taken.

In the course of step S1 represented in FIG. 1, there is undertaken the processing of a current block $B_n$ (n being an integer such that $1 \le n \le Z$). The current block $B_n$ contains the aforementioned fifteen/sixteen parameters (15 spectral coefficients and optionally the indicator VAD) which have been decoded by the decoding module DO1.

Preferably, step S1 is preceded by the preselection step S0, in the course of which are preselected, among the blocks $B_1, B_2, \ldots, B_Z$, solely blocks which contain data representative of voice activity, for which the indicator VAD is equal to 1.

In the course of the processing of said current block $B_n$, there is undertaken the search for the index $i_{HF}$ of the first spectral parameter $p(i_k)$ greater than $F_{th}$ in accordance with the following operation:

$$i_{HF} = \min\left(\arg_{i_k \in [i_o, i_1]} (p(i_k) \geq F_{th})\right)$$

It is obviously possible to choose as search interval $i_0=0$ and $i_1=15$. Advantageously, this search interval is reduced, therefore giving rise to faster and less complex detection. For example, by choosing $i_o=8$ instead of $i_0=0$.

Likewise, the search interval could be limited a little more by choosing $i_1=12$ instead of $i_1=15$.

In the example represented, the threshold frequency $F_{th}$ is equal to 4 kHz. The value of this frequency expressed as a normalized frequency with respect to 0.5 (corresponding to 6.4 kHz) then equals 0.3125 (i.e. 10240=0.3125*32768 in fixed point arithmetic Q15).

An example of pseudo-code in the C computer language of this step is given hereinbelow.

```
IHF= i1; move16();
FOR(i=i1-1; i>= i0; i--)
{
  {if(sub(p(i), Fth) >=0)
  {
    iHF =i; move16();
  }
}
```

There is thereafter undertaken, in the course of a step S2 represented in FIG. 1, the calculation of at least one local criterion on the current block $B_n$, on the basis of said spectral parameter of index $i_{HF}$.

The criterion chosen in this embodiment is:

$$F(i_{HF})=\text{sign}(i_{HF}-c)*(2i_{HF}-c)^2,$$

where sign(x)=−1 if x<0, and sign(x)=1 otherwise, with c=21.

An example of C pseudo-code of this step is given hereinbelow:

```
diff = shl(iHF, 1);
diff = sub(diff, c);
critLoc = L_mult0(diff, diff);
if(diff < 0) {
   critLoc= L_negate(critLoc);
}
```

Subsequent to the aforementioned step S2, a step S3 represented in FIG. 1 consists in deciding whether the predetermined frequency band is detected in the current block $B_n$, as a function of one of the criteria which was calculated in step S2.

Preferably, the decision is a soft decision given by the local criterion calculated in the previous step.

An example of C pseudo-code of this step is given hereinbelow:

```
decLoc=critLoc; move16( );
```

In practice, on completion of this step, the HD logo is intended to be displayed on the screen of the terminal TER with a higher or lower contrast which corresponds respectively to a higher or lower value of the calculated criterion.

By way of alternative, the decision is a hard decision determined by the local criterion calculated in the previous step.

An example of C pseudo-code of this alternative step is given hereinbelow:

```
decLoc = 1; move16(); /* NB */
if (critLoc<0)
{
  decLoc = 1; move16();/* WB */
}
```

In practice, on completion of this alternative step, the HD logo is intended to be displayed on the screen of the terminal TER if the calculated criterion is less than 0, or not to be displayed otherwise.

Advantageously, in the course of the optional step S4 represented in FIG. 1, in order to increase the reliability of the detection, the local detections are smoothed over several blocks (nbCount>1) by a window, optionally sliding. Here again, in a similar manner to the previous step, the detection on the window can be a soft or hard decision decGlob, whether the local detections were obtained by soft or hard decision.

Accordingly, the local decisions (soft or hard) are stored in the array of local decisions and are used to update the global criterion critGlob.

An example of C pseudo-code of this step is given hereinbelow in the case where the local decisions are soft (decLoc=critLoc) and the global decision hard:

After an initialization step—setting to zero of the variables critGlob and ind, and of the array tabDec[nbCount], for each data block for which a local decision decLoc has been determined:

```
critGlob = L_sub(critGlob, tabDec[ind]);
critGlob = L_add(critGlob, decLoc);
tabDec[ind]= decLoc; move32();
ind = add(ind, 1);
if(sub(ind, nbCount) == 0)
{
  ind = 0; move16();
}
flagWB = 1 ; /* assume WB */
if(critGlob > 0) {
  flagWB = 0; /* NB detected */
}
```

The global decision is taken here over a sliding window.

In a variant embodiment, the global decision is taken over non-overlapping windows. In this case, it is unnecessary to store an array of local decisions, it suffices to add the local decisions to the global criterion which is reinitialized to zero at the start of each processed window. An example of C pseudo-code of this variant is given hereinbelow in the case where the local decisions are soft (decLoc=critLoc) and the global decision hard:

After an initialization step—setting to zero of the variables critGlob and ind, for each data block for which a local decision decLoc has been determined:

```
critGlob = L_add(critGlob, decLoc);
ind = add(ind, 1);
IF (sub(ind, nbCount) == 0)
{
  ind = 0; move16();
  flagWB = 1; move16();
  /* assume WB */
  if(critGlob > 0) {
      flagWB = 0; move16();/* NB detected */
  }
  critGlob = 0; move32();
}
```

The application which has just been described hereinabove thus effects a compromise between the responsivity time of the displaying or non-displaying of the HD logo and the reliability of detection.

Furthermore, the complexity of the calculations is relatively low as shown by the table hereinbelow which indicates the weight of certain of the instructions mentioned hereinabove:

| Instructions | Weight in terms of complexity | Label of the instruction |
|---|---|---|
| Memory access (write or read) 16-bit word | 1 | move16( ) |
| Memory access (write or read) 32-bit word | 2 | move32( ) |
| Add/subtract 2 words of 16 bits | 1 | add( )/sub( ) |
| Add/subtract 2 words of 32 bits | 1 | L_add( )/L_sub( ) |
| Binary shift to the left (multiplication by a power of 2) | 1 | shl( ) |
| Multiplication of 2 words of 16 bits | 1 | L_mult0( ) |
| "Simple" test (followed by a single simple base operator) | 0 | if |
| Loop performed a constant number of times N | 4 | FOR |

We shall now describe a second application of the detection method which has been described above with reference to FIG. 1, with a view to the indication of the number of calls that have been left in wideband on a mobile voice messaging server.

Such a server is designated by the reference SER in FIG. 6B.

In particular, such a server comprises in a conventional manner:

- a set EBR of message inboxes,
- a communication module COM2, for example of IP type,
- a read-only memory MEM2 which contains a module GES for managing the voice messages recorded in the inboxes of the aforementioned set EBR.

The memory MEM2 furthermore contains a decoding module DO2 and an encoding module CO2 which are intended if necessary respectively to decode, and then re-encode the audio content of the voice message that was left.

Such an operation turns out to be necessary for example in the case where the audio content of the voice message that has been left was initially coded by a coder which is different from the coder contained in the terminal intended to consult said voice message or offered by the network during the consultation of said message.

Such an operation may also turn out to be necessary with a view to storing a voice message left in a different coding format, and this may be a choice of the operator for an application of webmail type for example which is aimed at offering the message on the mailbox of the owner of the voice messaging.

In accordance with the invention, the read-only memory MEM2 or else another memory of the server SER furthermore contains:

- a detection device DET2 for detecting a predetermined frequency band, similar to the detection device DET represented in FIG. 2,
- a partial decoding module DP.

In the case where the voice messages left in the server SER are coded streams which do not need to be immediately decoded and then re-encoded by the decoding module DO2 and the encoding module CO2 respectively, because, for example, the webmail application is not available at the operator, the partial decoding module DP is able, prior to the detection of the HF content, to decode part only of the first 15 ISF coefficients and optionally the indicator VAD. Such a provision is possible having regard to the vector quantization of the ISF coefficients according to two sub-vectors, such as implemented in a coder of the AMR-WB type. It is appropriate to recall that such a quantization is implemented with the aid of a combination well known to the person skilled in the art of a quantization scheme of product-codes type SVQ (the abbreviation standing for "Split Vector Quantization") and of a quantization scheme of multi-stage type MSVQ (the abbreviation standing for "Multi Stage Vector Quantization").

Thus, in accordance with the invention, the decoding module DP decodes only the second sub-vector of the ISF coefficients, that is to say the one which contains the highest index last eight ISF coefficients, whose distribution is more apt to demonstrate the presence of HF content. Optionally, the decoding module DP decodes the indicator VAD.

Such a provision makes it possible advantageously to reduce the calculational complexity of the detection of the frequency band of the coded audio stream. Such a provision furthermore makes it possible to economize on the resources of the memory MEM2 by eliminating the instructions for decoding the first sub-vector of the ISF coefficients and the storage of its vector quantization dictionaries.

On the basis of a part of the decoded spectral coefficients thus obtained, the detection device DET2 of the server SER then directly implements the predetermined frequency band detection method such as described in FIG. 1.

Steps S0 to S4 of this method are similar to those which have just been described hereinabove in conjunction with the terminal TER of FIG. 6A. They will therefore not be described again.

In this second application more particularly, the fact of limiting the decoding to a part only of the spectral parameters advantageously makes it possible, in return for low processing cost, to identify on the frames coded by a linear predictive coder such as the AMR-WB, whether the coded content does indeed have high-frequency components and therefore whether it is actually HD and thus to have relevant information of the audio band of the contents at the level of a system not performing any decoding of binary streams (such as a voice messaging server).

According to an alternative which corresponds to the case where the voice messages left in the server SER are coded streams which need to be decoded and then re-encoded by the decoding module DO2 and the encoding module CO2 respectively (e.g.: webmail application), the decoding module DP then operates in the same manner as the decoding module DO1 which was described with reference to FIG. 6A.

It goes without saying that the embodiments which were described hereinabove were given on a purely indicative and wholly non-limiting basis, and that numerous modifications may easily be made by the person skilled in the art without however departing from the scope of the invention.

Thus for example, the method for detecting a predetermined frequency band, instead of being used in a messaging server in partial decoding mode, could be used in a similar manner in a probe spliced into an audio stream.

Furthermore, the method for detecting a predetermined frequency band is not necessarily limited to the contents coded by a wideband coder. This bandwidth may also be variable.

Likewise, the detection method could be implemented to detect a content in the band of low frequencies instead of a content in the band of high frequencies. In this case, as mentioned previously, the aforementioned determining step S2 would naturally consist in searching, among at least one plurality of previously decoded spectral parameters of the set of spectral parameters, for the index of the largest spectral parameter below a threshold frequency.

The threshold frequency $F_{th}$ could moreover vary in the course of one of the aforementioned applications.

The detection method can also be implemented according to several variants, both in the choice of the criteria, in the way of optionally combining several criteria, or else in the use of soft or hard decisions, both locally and globally. According to the variant selected, it is then possible to optimize the detection complexity/reliability/responsivity compromise.

Finally, although the invention has been described in conjunction with a mobile communication network, the former may of course be implemented in conjunction with other types of communication networks (fixed network of RTC, mobile VoIP type, etc.) in which a linear predictive coder is apt to be used.

The invention claimed is:

1. A method comprising the following acts performed by a terminal having a processor that is configured by instructions stored in a non-transitory computer-readable medium, wherein the method comprises:

receiving, by the terminal, an audio data signal which has been previously coded according to a succession of data blocks, among which at least certain blocks contain respectively at least one set of spectral parameters representing a linear prediction filter;

decoding at least one of said certain blocks that contains at least one set of spectral parameters representing a linear prediction filter, at least one plurality of spectral parameters of said set being decoded as a result of said decoding; and implementing, for at least one decoded current block, the following acts:

calculating, as a function of an index of the decoded spectral parameter closest to a threshold frequency, a value of a decision criterion representing detection of whether a predetermined frequency band is present in said audio data signal received, and displaying an HD logo on a display screen of the terminal as a function of the calculated value of the decision criterion to indicate a quality of the audio data signal received and whether the predetermined frequency band is present in said received audio data signal.

2. The method of claim 1, wherein displaying comprises the terminal modifying a contrast of the displayed HD logo as a function the calculated value of said decision criterion, a higher or lower contrast of the HD logo corresponding to a higher or lower calculated value of said decision criterion.

3. A terminal comprising:

a display screen;

a processor; and a non-transitory computer-readable medium comprising instructions stored thereon, which when executed by the processor configure the terminal to perform acts comprising:

receiving an audio data signal which has been previously coded according to a succession of data blocks, among which at least certain blocks contain respectively at least one set of spectral parameters representing a linear prediction filter;

decoding at least one of said certain blocks that contains at least one set of spectral parameters representing a linear prediction filter, at least one plurality of spectral parameters of said set being decoded as a result of said decoding; and for at least one decoded current block:

calculating, as a function of an index of the decoded spectral parameter closest to a threshold frequency, a value of a decision criterion representing whether a predetermined frequency band is present in said audio data signal received, and displaying an HD logo on a display screen of the terminal as a function of the calculated value of the decision criterion to indicate a quality of the audio data signal received and whether the predetermined frequency band is present in said received audio data signal.

4. The terminal of claim 3, wherein displaying comprises the terminal modifying a contrast of the displayed HD logo as a function the calculated value of said decision criterion, a higher or lower contrast of the HD logo corresponding to a higher or lower calculated value of said decision criterion.

* * * * *